US006186413B1

(12) United States Patent
Lawson

(10) Patent No.: US 6,186,413 B1
(45) Date of Patent: Feb. 13, 2001

(54) DEBRIS TOLERANT INLET CONTROL VALVE FOR AN IRRIGATION SPRINKLER

(75) Inventor: Kenneth L. Lawson, Rancho Cucamonga, CA (US)

(73) Assignee: Anthony Manufacturing Corp., Azusa, CA (US)

( * ) Notice: Under 35 U.S.C. 154(b), the term of this patent shall be extended for 0 days.

(21) Appl. No.: 09/370,119

(22) Filed: Aug. 6, 1999

(51) Int. Cl.[7] ..... B05B 15/10

(52) U.S. Cl. ..... 239/205; 239/206; 239/237; 239/570; 239/575

(58) Field of Search ..... 239/200, 203–206, 239/237, 240, 228, 570, 575, 571

(56) References Cited

U.S. PATENT DOCUMENTS

| | | | | |
|---|---|---|---|---|
| 4,081,171 | | 3/1978 | Morgan et al. . | |
| 4,226,259 | | 10/1980 | Szekely et al. . | |
| 4,637,548 | | 1/1987 | Ray et al. . | |
| 4,787,558 | * | 11/1988 | Sexton et al. | 239/205 |
| 5,375,768 | * | 12/1994 | Clark | 239/205 X |
| 5,779,148 | * | 7/1998 | Saarem et al. | 239/205 X |
| 5,871,156 | | 2/1999 | Lawson . | |
| 5,899,386 | | 5/1999 | Miyasato et al. . | |
| 5,927,607 | * | 7/1999 | Scott | 239/205 |
| 5,964,408 | * | 10/1999 | Musson | 239/205 X |

* cited by examiner

*Primary Examiner*—Andres Kashnikow
*Assistant Examiner*—Steven J. Ganey
(74) *Attorney, Agent, or Firm*—Kelly Bauersfeld Lowry & Kelley, LLP

(57) ABSTRACT

An improved inlet control valve is provided for controlling water inflow to an irrigation sprinkler, wherein the inlet control valve exhibits improved tolerance to passage of small grit and debris. The inlet control valve includes a valve member normally engaging a valve seat to prevent water inflow to the irrigation sprinkler, and adapted for movement to a modulated open position to permit water inflow to the sprinkler at a regulated pressure. The valve member carries a flow restrictor disposed upstream from the valve seat to produce, when the valve member is in the open position, a first pressure drop which cooperates with a second pressure drop between the valve seat and valve member to regulate the water inflow pressure. The inclusion of the upstream flow restrictor and the associated first pressure drop effectively reduces the magnitude of the second pressure drop across the valve seat and thereby permits the valve member to open with an increased clearance relative to the valve seat. Such increased clearance enhances flush flow passage of grit and debris past the valve seat, with reduced risk of particulate entrapment between the valve member and valve seat.

18 Claims, 4 Drawing Sheets

DEBRIS TOLERANT INLET CONTROL VALVE FOR AN IRRIGATION SPRINKLER

BACKGROUND OF THE INVENTION

This invention relates generally to irrigations sprinklers of the type having an inlet control valve for controlling water inflow to the sprinkler at a regulated pressure. More particularly, this invention relates to an improved inlet control valve designed for improved flush flow passage of grit and debris to correspondingly reduce the risk of trapping grit and debris between a valve member and an associated valve seat.

Irrigation sprinklers of the type having an inlet control valve for controlling water inflow at a regulated pressure are generally well known in the art. Such sprinklers commonly comprise a hollow sprinkler housing or case having a sprinkler mechanism mounted therein. Water under pressure is supplied to the case interior via an inlet fitting located typically at a lower end thereof, resulting in water-powered operation of the sprinkler mechanism to deliver irrigation water through one or more spray nozzles to surrounding vegetation such as grass, shrubs, crops, and the like. The inlet control valve is mounted generally at the inlet fitting and includes a valve member movable between closed and open positions relative to a valve seat for respectively preventing and permitting water inflow to the sprinkler. In the open position, the clearance between the valve member and the valve seat is modulated so that water is supplied to the sprinkler mechanism at a regulated and preferably substantially constant pressure, to achieve a predictable and repeatable delivery of irrigation water to the surrounding terrain. In one common design, the inlet control valve is adapted for automated remote control operation by means of a solenoid powered pilot valve actuator or the like, whereby a plurality of irrigation sprinklers may be employed in an irrigation system and turned on and off from a remote master control station to achieve individually timed watering cycles.

Exemplary irrigation sprinklers equipped with a pressure regulating inlet control valve are shown and described in U.S. Pat. No. 4,637,548; 5,871,156; and 5,899,386. Exemplary pilot valve actuators for opening and closing a control valve, and for operating the open control valve to maintain a substantially constant downstream regulated pressure, are shown and described in U.S. Pat. Nos. 4,081,171 and 4,226,259. Commercially available irrigation sprinklers having pressure regulated inlet control valves include the Rain Bird 47/51 impact drive series and the Rain Bird 900/950 rotor drive series sprinklers, marketed by Rain Bird Sprinkler Mfg., Corp., of Glendora, Calif.

The specific clearance between the open valve member and the associated valve seat of the pressure regulated inlet control valve is a function of the water supply pressure at the upstream side of the valve seat as well as the design rate of water flow through the sprinkler during normal operation. In this regard, the clearance spacing can be relatively small, on the order of about 0.010 inch, when the upstream water supply pressure is relatively high in relation to the regulated downstream pressure within the sprinkler case. Similarly, the clearance spacing can be relatively small when the sprinkler is designed to operate at a relatively low water flow rate. Such small clearance between the open valve member and the valve seat increases the likelihood of trapping small particles of dirt and debris present in the water supply source. Such entrapment of dirt and debris at the valve seat, particularly upon subsequent movement of the valve member to the closed position, can result in damage to sealing surfaces and thus contribute to water leakage through the sprinkler case when the sprinkler is otherwise turned off. This water leakage creates a soggy ground condition surrounding the sprinkler and thereby exposes grass and other vegetation within this soggy zone to over-watering and to potential physical damage when subjected to foot or vehicle traffic.

Another problem encountered with such irrigation sprinklers relates to initial pulsing or oscillation of the valve member when the sprinkler is initially turned on. More particularly, during operating conditions as described above wherein the steady state clearance between the valve member and the valve seat is relatively small, the valve member tends initially to move beyond the desired clearance position when the sprinkler is turned on. The inlet control valve responds to such over-opening by moving the valve member back toward the valve seat. Such back and forth oscillation of the valve member can continue through several cycles before the desired steady state clearance position is reached to achieve the desired steady state regulation of water pressure. During this initial oscillatory or pulsating phase, the valve member can physically contact the valve seat with a sufficient force to present a risk of damage to the valve member or valve seat, wherein such damage can also result in undesired water leakage through the sprinkler case when the sprinkler is turned off.

The present invention is directed to an improved inlet control valve for use in an irrigation sprinkler to provide close regulation of water pressure, wherein the improved inlet control valve incorporates means for insuring valve member movement to an open position with a substantial clearance relative to an associated valve seat, and further wherein the valve member is resistance to oscillatory displacement when the sprinkler is turned on.

SUMMARY OF THE INVENTION

In accordance with the invention, an improved debris tolerant inlet control valve is provided for water inflow to an irrigation sprinkler. The inlet control valve comprises a valve member movable between open and closed positions relative to a valve seat for respectively permitting and preventing water inflow into a sprinkler case having a water-powered sprinkler mechanism mounted therein for distributing irrigation water to a surrounding terrain area. A flow restrictor disposed upstream from the valve seat produces, when the valve member is in the open position, a first pressure drop which cooperates with a second pressure drop between the valve seat and valve member to regulate the water pressure within the sprinkler case. The upstream flow restrictor and the first pressure drop associated therewith effectively reduces the magnitude of the second pressure drop across the valve seat and thereby permits the valve member to open with an increased clearance relative to the valve seat. Such increased clearance enhances flush flow passage of grit and debris past the valve seat, with reduced risk of entrapment between the valve member and valve seat.

In one preferred form, the sprinkler case comprises a hollow housing defining a water inlet fitting adapted for connection to a suitable water supply line. The inlet control valve is mounted within the sprinkler case to regulate water inflow through the inlet fitting in a manner maintaining water pressure within the sprinkler case at a predetermined and substantially constant pressure level. The water-powered sprinkler mechanism such as a pop-up spray head which may include rotary drive means is operated to deliver one or more sprays of irrigation water to surrounding vegetation. In a preferred form, the valve member of the inlet control valve is carried by a resilient diaphragm for movement between the open and closed positions in response to the pressure level within a control chamber, wherein the pressure level within this control chamber is responsive to automated or manual override operation of a solenoid powered valve actuator as shown and described in U.S. Pat. Nos. 4,637,548; 4,081,171; and 4,226,259, which are incorporated by reference herein.

The flow restrictor is carried by the valve member and protrudes therefrom into an inlet flow path at the upstream side of the valve seat. The flow restrictor includes a metering element positioned within the inlet flow path to define a predetermined clearance orifice which produces the first pressure drop at a location upstream from the valve seat, when the valve member is in the open position. This first pressure drop associated with the flow restrictor, which cooperates with the second pressure drop across the valve seat to regulate the water pressure within the sprinkler case, permits the second pressure drop to be of reduced magnitude and thereby also permits the valve member to open with increased clearance relative to the valve seat. This increased clearance spacing between the valve member and the valve seat enables particulate such as dirt and debris to flush past the valve seat without significant risk of entrapment and potential risk of damage to valve sealing surfaces.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
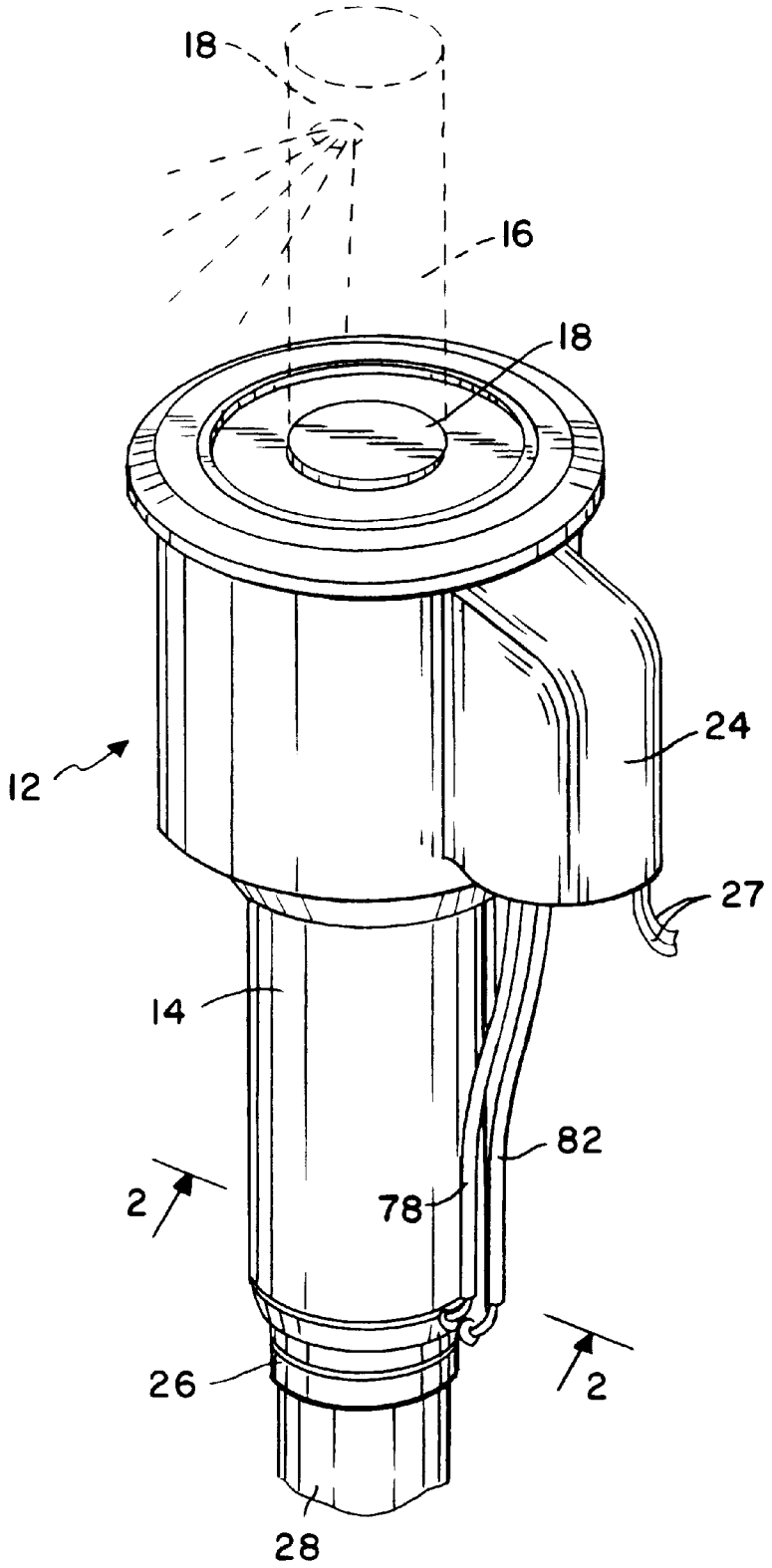
FIG. 1 is a fragmented perspective view of an irrigation sprinkler of the type having an inlet control valve incorporating debris tolerant features in accordance with the present invention.

As shown in the exemplary drawings, an improved inlet control valve referred to generally by the reference numeral 10 (FIG. 2) is provided for regulating water inflow to an irrigation sprinkler 12 (FIG. 1). The inlet control valve is designed to maintain a predetermined and substantially constant water pressure within a hollow sprinkler housing or case 14 to achieve predictable and substantially repeatable operation of a sprinkler mechanism 16 including at least one spray head or nozzle 18 for distributing irrigation water to a surrounding terrain area. In accordance with the invention, the inlet control valve 10 accommodates improved flush flow passage of grit and debris to correspondingly reduce the risk of trapping grit and debris between a valve member 20 (FIG. 2) and an associated valve seat 22.

The illustrative irrigation sprinkler 12 shown in FIG. 1 includes the hollow sprinkler case 14 formed typically from lightweight molded plastic or the like with a generally upright cylindrical configuration. The sprinkler mechanism 16 is mounted within the sprinkler case 14 and typically comprises a pop-up sprinkler device adapted for normal retraction substantially within the case 14 when the sprinkler is turned off (shown in solid lines in FIG. 1), and for water-powered movement displacing the spray head or nozzle 18 to an elevated spraying position when the sprinkler is turned on (shown in dotted lines in FIG. 1). Moreover, in a typical sprinkler design, the sprinkler mechanism commonly includes water-powered drive means (not shown) for rotary driving of the spray head 18 in a manner to distribute the outwardly projected stream or streams of irrigation water over a prescribed part-circle or full circle terrain pattern to irrigate surrounding vegetation such as grass, shrubs, crops, and the like. The inlet control valve 10 is mounted within the sprinkler case 14 and includes the valve member 20 movable between closed and open positions relative to the valve seat 22 for respectively preventing and permitting water inflow to the sprinkler. In a preferred form, the inlet control valve 10 is adapted for automated remote on-off control and pressure regulating operation by means of a solenoid powered pilot valve actuator 24 (FIG. 1) or the like, whereby a plurality of irrigation sprinklers 12 may be employed in an irrigation system and individually regulated by signals transmitted over conductive wires 27 or the like from a remote master control station (not shown) to achieve individually timed watering cycles. Exemplary irrigation sprinklers of this general type are shown and described in U.S. Pat. Nos. 4,637,548; 5,871,156; and 5,899,386, which are incorporated by reference herein. Commercially available irrigation sprinklers of this general type include the Rain Bird 47/51 impact drive series and the Rain Bird 900/950 rotor drive series sprinklers, marketed by Rain Bird Sprinkler Mfg., Corp., of Glendora, Calif.

Figure 2:
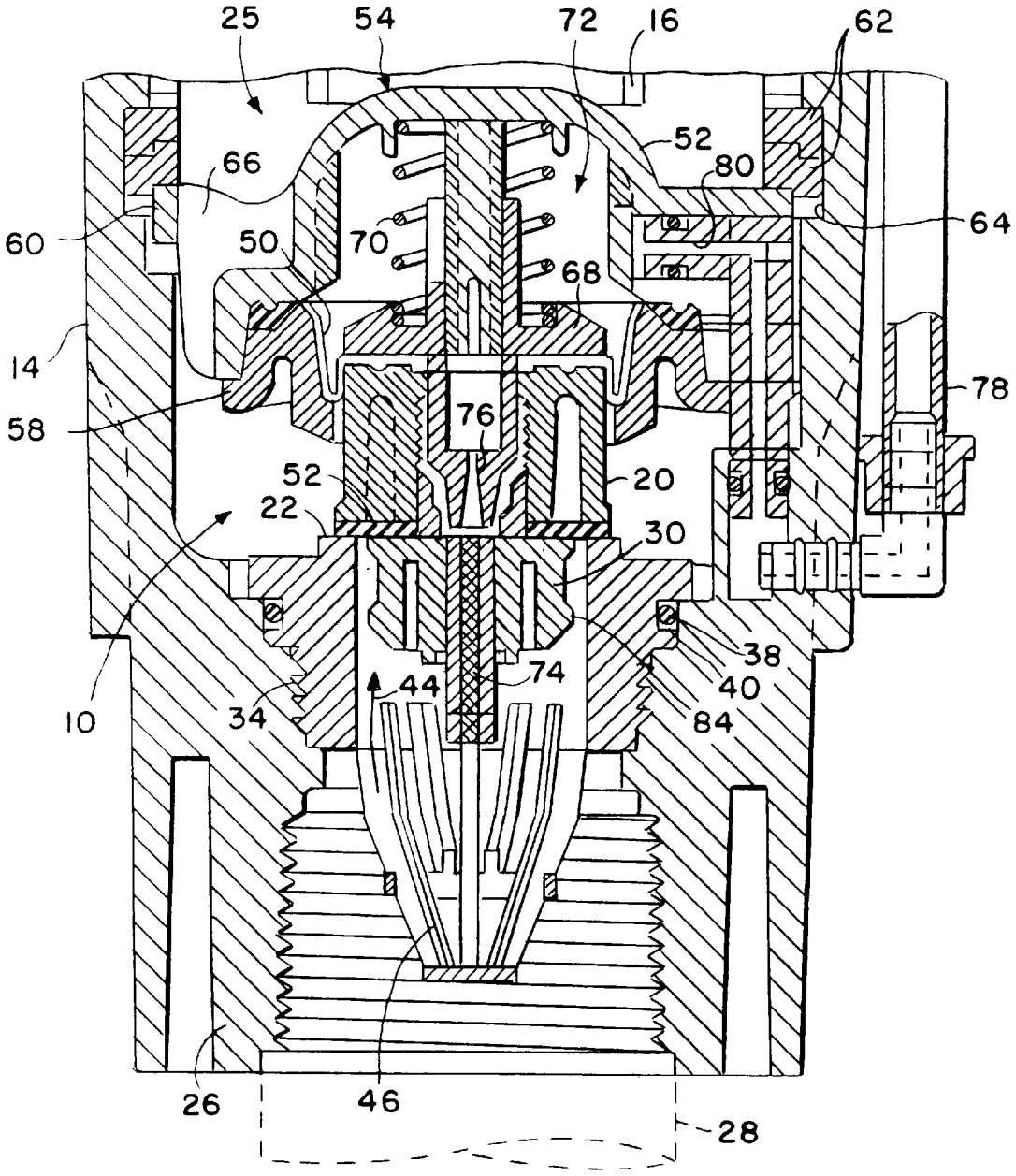
FIG. 2 is an enlarged fragmented vertical sectional view taken generally on the line 2—2 of FIG. 1, and illustrating the inlet control valve mounted within a lower end of a hollow sprinkler case and including a valve member in a closed position.

The inlet control valve 10 is integrated into the sprinkler case 14 generally at a base or lower end thereof to regulate water inflow upwardly into the hollow housing interior 25. More particularly, as shown in FIG. 2, the inlet control valve 10 is mounted within the case 14 generally at the upper or downstream end of an inlet fitting 26 shown in the form of an internally threaded member at the bottom of the case 14 for suitable coupling to the upper end of a water supply riser 28. Water under pressure from an appropriate supply source is coupled to the sprinkler 12 via the supply riser 28 and inlet fitting 26, wherein the pressure of the water source typically varies and also typically exceeds a predetermined design pressure for operation of the sprinkler mechanism 16. When the sprinkler is turned on, the inlet control valve 10 regulates the water pressure within the case 14 by producing a controlled total pressure drop between the supply riser 28 and the hollow case interior 25, so that the water inflow for operating the sprinkler mechanism 16 is maintained substantially at the design pressure level to achieve predictable and repeatable operation thereof to deliver irrigation water to the surrounding terrain. In accordance with the invention, the inlet control valve 10 additionally includes an upstream flow restrictor 30 which renders the valve 10 highly tolerant to flush flow passage of small water-borne particulate such as grit and debris which could otherwise become trapped between the valve member 20 and the associated valve seat 22 to result in undesired leakage through the sprinkler when the sprinkler is turned off.

Figure 3:
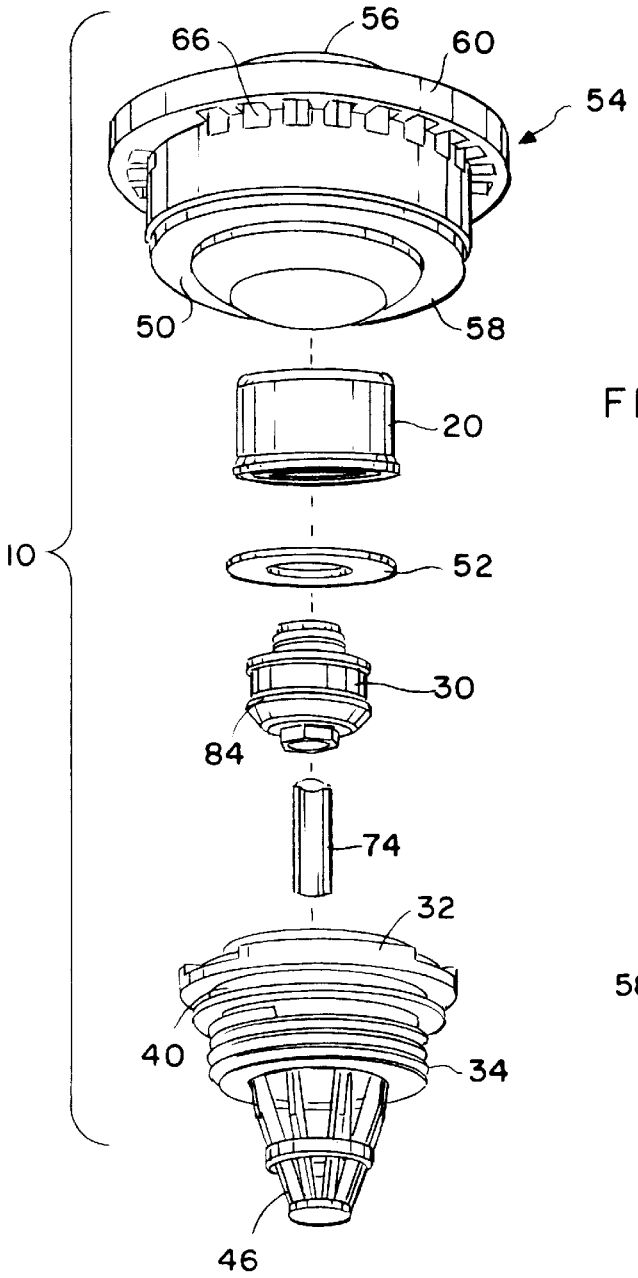
FIG. 3 is an exploded perspective view showing components of the inlet control valve.
Figure 4:
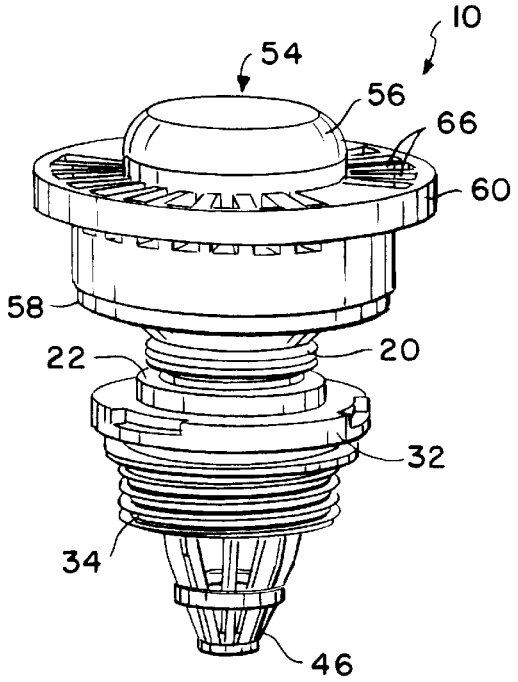
FIG. 4 is an assembled perspective view of the inlet control valve.

As shown best in FIGS. 2–4, the inlet control valve 10 comprises a valve seat ring 32 of molded plastic or the like shown to include an externally threaded segment 34 for secure mounting within an internally threaded bore formed within the case 14 at the upstream side of the inlet fitting 26. An external seal ring 38 such as a conventional resilient 0-ring may be trapped within an external groove 40 in the seat ring 32 and sized for sealingly engaging an internal wall 42 defined by a stepped shoulder near the lower end of the sprinkler case. With this construction, water inflow from the supply riser 18 to the hollow sprinkler interior 25 is confined to passage through a flow path 44 defined by a generally cylindrical boundary wall extending through the seat ring 32. As shown in FIG. 2, a relatively coarse rock screen 46 protrudes from an upstream end of the seat ring 32 and functions to capture pebbles and other relatively sizable water-borne debris to prevent flow thereof into the sprinkler. A downstream end of the seat ring 32 includes the valve seat 22 of generally annular shape.

The valve member 20 of the inlet control valve 10 comprises a valve piston carried by a spring biased and pressure responsive resilient diaphragm 50 for movement between a normal closed position (FIG. 2) with a resilient seal washer 52 engaging the valve seat 22, and an open position (FIG. 5) retracted from the valve seat 22 to permit water inflow into the interior 25 of the sprinkler case 14. Alternately, it will be understood that a resilient seal member (not shown) may be mounted on the valve seat 22 in lieu of or in addition to the seal washer 52 on the valve member. The closed or open position of the valve piston is controlled by the pilot valve actuator 24 for turning the sprinkler on and off. When the sprinkler is turned on, the pilot valve actuator 24 further regulates the position of the diaphragm 50 in a manner to control the clearance between the valve member 20 and the valve seat 22 and thereby achieve a substantially constant regulated water pressure level within the sprinkler case interior 25.

More particularly, the inlet control valve 10 comprises a valve housing 54 mounted within a lower region of the sprinkler case 14 in a position spaced a short distance above the seat ring 32. This valve housing includes an upper housing element 56 assembled with a lower housing element 58 in a manner capturing and retaining an outer peripheral margin of the resilient diaphragm 50 therebetween. The upper housing element 56 further includes an outwardly radiating peripheral rim 60 engaged by one or more overlying lock rings 62 seated within a radially inwardly open lock groove 64 formed in the sprinkler case 14 to retain the valve housing 54 therein. A plurality of upwardly open flow ports 66 are formed in the rim 60 to permit water flow upwardly past the valve housing 54 into operative and water-powered drive relation with the overlying sprinkler mechanism 16.

The piston-type valve member 20 comprises a generally cylindrical element having a lower end carrying the resilient seal washer 52, and an upper end suitably secured to a central zone of the resilient diaphragm 50. As shown in the illustrative drawings, this central zone of the diaphragm is sandwiched between the valve member 20 and an overlying clamp plate 68 retained against the diaphragm 50 by a biasing spring 70 which reacts in turn against the upper housing element 56. The biasing spring 70 applies a downward force to the diaphragm 50 and the valve member 20 for normally urging the valve member 20 toward the closed position with the seal washer 52 sealingly engaging the valve seat 22, as shown in FIG. 2.

The resilient diaphragm 50 cooperates with the valve housing 54 to define a control chamber 72 overlying the diaphragm 50 and the valve member 20 carried thereby. Water under pressure from the inlet fitting 26 at a location upstream from the valve seat 22 is communicated with this control chamber 72 to supplement the downward force applied by the biasing spring 70 for normally retaining the valve member 20 in the closed position. In this regard, a relatively fine mesh filter screen 74 is carried by and protrudes downwardly from the valve member 20 into the flow path 44 defined by the seat ring 32. When the sprinkler is turned off, this filter screen 74 admits a small water flow through an orifice 76 formed centrally in the valve member 20, and further through the diaphragm 50 and overlying clamp plate 68 into the control chamber 72. In the off condition, the control chamber 72 is otherwise closed, so that the pressure level therein corresponds substantially with the water supply pressure upstream from the valve seat 22.

Figure 5:
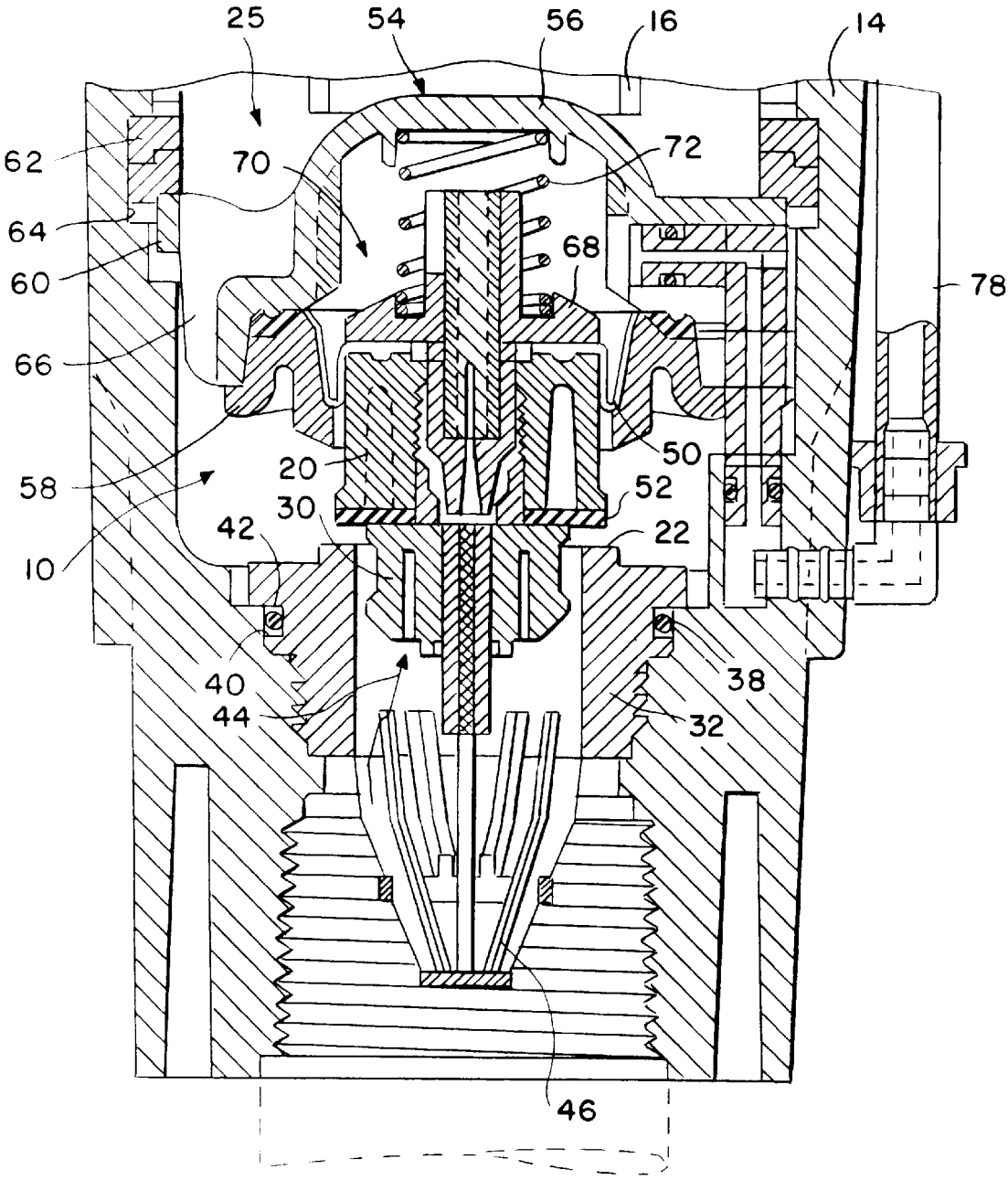
FIG. 5 is an enlarged fragmented vertical sectional view similar to FIG. 2, but depicting the inlet control valve is an open position.

When it is desired to turn the sprinkler on, the pilot valve actuator 24 operates the inlet control valve 10 for displacing the valve member 20 to the open position (shown in FIG. 5). Such actuation of the inlet control valve 10 is accomplished by connecting the control chamber 72 to a relatively low pressure site for purposes of venting or bleeding the accumulated pressure therein. In the preferred form, bleeding of the control chamber 72 is accomplished by automated or manual override operation of the pilot valve actuator 24 (FIG. 1) for coupling a first drain tube 78 (FIGS. 1 and 2) communicating with the control chamber 72 via a drain port 80 with a second drain tube 82 (FIG. 1) coupled in turn to a low pressure site such as a point downstream from the valve seat 22. Relieving the accumulated pressure within the control chamber 72 permits the water supply pressure at the upstream side of the valve seat 22 to overcome the biasing force applied by the spring 70 resulting in opening movement of the valve member 20. The valve actuator 24 desirably includes means for regulating the bleeding of pressure from the control chamber 72 in a manner achieving a predetermined and substantially constant pressure level at the downstream side of the valve seat 22, within the hollow interior 25 of the sprinkler case 14. Subsequent re-closure of the valve member 20 is accomplished by operation of the valve actuator 24 to re-close the bleed path through the drain tubes 78 and 82, whereby the resultant rising fluid pressure level within the control chamber 72 will again supplement the force of the biasing spring 70 and return the valve member 20 to the closed position. Further details regarding the construction and operation of the pilot valve actuator 24 for maintaining a substantially constant regulated pressure at the downstream side of the valve seat are set forth in U.S. Pat. Nos. 4,081,171 and 4,226,259, which are incorporated by reference herein.

In accordance with a primary aspect of the invention, the upstream flow restrictor 30 provides an additional pressure drop, in series with a pressure drop across the valve seat 22, when the valve member 20 is in the open position. More specifically, the upstream flow restrictor 30 comprises, in the preferred form as shown in the exemplary drawings, a generally cylindrical plug or nut which is suitably attached to the valve member 20 or otherwise formed integrally therewith as a reduced diameter extension thereof. The flow restrictor 30 protrudes generally coaxially into the flow path 44 at the upstream side of the valve seat 22, and includes a radially outwardly protruding annular bead 84 formed on or near an upstream or nose end thereof. This restrictor bead 84 comprises a flow metering element sized for a predetermined and sufficiently close clearance with respect to the cylindrical boundary wall defining the flow path 44 to produce a first pressure drop at a location upstream from the valve seat 22, and downstream from the riser 28 and its associated connection with the inlet fitting 26. Accordingly, when the valve member 20 is in the open position, a first pressure drop occurs between the metering bead 84 and the flow path boundary wall, whereas a second pressure drop occurs across the valve seat 22 through the clearance between the open valve member 20 and the valve seat. The sum of these two pressure drops regulates the magnitude of the water pressure within the case interior 25, with the pilot valve actuator 24 modulating the specific clearance between the valve member 20 and the seat 22 to maintain a substantially constant regulated pressure with the sprinkler case 14 for powering the sprinkler mechanism 16.

Importantly, with the addition of the upstream flow restrictor 30, the magnitude of the second pressure drop associated with the valve seat 22 is reduced for any given water supply pressure. This reduction in the actual pressure drop across the valve seat 22 permits the valve member 20 to be displaced to an open position with relatively increased clearance between the seal washer 52 and the valve seat 22, in relation to the clearance which would otherwise be present in the absence of the upstream flow restrictor 30. Such increased clearance at the valve seat 22 beneficially permits water-borne particulate such as dirt and grit to flush past the valve seat 22, without significant risk of entrapment between the valve member and valve seat. As a result, potential damage to sealing surfaces caused by trapped particulate especially when the sprinkler is subsequently turned off, is avoided. The clearance between the flow restrictor 30 and the adjacent boundary wall of the seat ring 32 is also sufficient to avoid entrapment of typical water-borne debris therebetween. In addition, this increased clearance between the valve member 20 and the associated valve seat 22 for a given water supply pressure reduces the tendency of the valve member to oscillate of pulse prior to achieving a relatively steady state open position when the sprinkler is turned on.

The improved inlet control valve of the present invention thus provides a relatively simple yet highly effective construction for providing close regulation of water inflow to an irrigation sprinkler, without significant risk of trapping water-bome particulate and an associated risk of water leakage attributable to damaged valve sealing surfaces. Instead, by providing an additional pressure drop at a location upstream from the sealing surfaces, the actual pressure drop between the sealing surfaces is decreased to result in a greater clearance between the sealing components. This increased component clearance accommodates flush flow passage of dirt and debris without significant likelihood of trapping particulate material therebetween.

A variety of modifications and improvements in and to the improved inlet control valve of the present invention will be apparent to those skilled in the art. Accordingly, no limitation on the invention is intended by way of the foregoing description and accompanying drawings, except as set forth in the appended claims.

What is claimed is:

1. In an irrigation sprinkler having a sprinkler case defining a hollow interior and an inlet fitting for water inflow from a water supply source into said case interior, an inlet control valve including a valve member movable relative to a valve seat between a closed position preventing water inflow into said case interior and an open position permitting water inflow into said case interior at a regulated pressure, and a water-powered sprinkler mechanism mounted within said case interior for delivering irrigation water to a surrounding terrain area when said valve member is in said open position, the improvement comprising:

a flow restrictor disposed upstream from said valve seat for producing a pressure drop upstream from said valve seat when said valve member is in said open position; and a seat ring mounted on said sprinkler case at a position generally between said inlet fitting and said case interior, said seat ring having said valve seat formed thereon and further including a generally cylindrical boundary wall extending in an upstream direction from said valve seat to define a flow path at the upstream side of said valve seat; said flow restrictor being carried by said valve member to protrude into said flow path and including a radially outwardly extending metering bead formed thereon and positioned in relatively close clearance with said boundary wall to produce the pressure drop upstream from said valve seat when said valve member is in said open position.

2. The improvement of claim 1 further including a rock screen positioned generally at an upstream end of said flow path defined by said boundary wall.

3. The improvement of claim 1 wherein said inlet control valve includes pressure responsive means for displacing said valve member between said open and closed positions.

4. The improvement of claim 3 wherein said pressure responsive means comprises a spring biased diaphragm, and housing means cooperating with said diaphragm to define a control chamber at one side of said diaphragm.

5. The improvement of claim 1 further including a resilient seal member carried by one of said valve member and said valve seat.

6. An irrigation sprinkler, comprising:

a sprinkler case defining a hollow interior and an inlet fitting for water inflow from a water supply source into said case interior;

an inlet control valve including a valve member movable relative to a valve seat between a closed position preventing water inflow into said case interior and an open position permitting water inflow into said case interior at a regulated pressure;

a sprinkler mechanism mounted within said case interior for delivering irrigation water to a surrounding terrain area when said valve member is in said open position;

a flow restrictor disposed upstream from said valve seat for producing a pressure drop upstream from said valve seat when said valve member is in said open position; and a seat ring mounted on said sprinkler case at a position generally between said inlet fitting and said case interior, said seat ring having said valve seat formed thereon and further including a generally cylindrical boundary wall extending in an upstream direction from said valve seat to define a flow path at the upstream side of said valve seat, said flow restrictor being carried by said valve member to protrude into said flow path and including a radially outwardly extending metering bead formed thereon and positioned in relatively close clearance with said boundary wall to produce the pressure drop upstream from said valve seat when said valve member is in said open position.

7. The irrigation sprinkler of claim 6 wherein said inlet fitting is formed generally at a lower end of said sprinkler case.

8. The irrigation sprinkler of claim 7 wherein said valve seat is formed generally at said lower end of said sprinkler case at a position generally between said inlet fitting and said case interior.

9. The irrigation sprinkler of claim 6 further including a rock screen positioned generally at an upstream end of said flow path defined by said boundary wall.

10. The irrigation sprinkler of claim 6 wherein said inlet control valve includes pressure responsive means for displacing said valve member between said open and closed positions.

11. The irrigation sprinkler of claim 10 wherein said pressure responsive means comprises a spring biased diaphragm, and housing means cooperating with said diaphragm to define a control chamber at one side of said diaphragm.

12. The irrigation sprinkler of claim 11 further including a pilot valve actuator for controlling fluid pressure within said control chamber to regulate operation of said inlet control valve.

13. The irrigation sprinkler of claim 6 further including a resilient seal member carried by one of said valve member and said valve seat.

14. In an irrigation sprinkler having a sprinkler case defining a hollow interior and an inlet fitting for water inflow from a water supply source into said case interior, and an inlet control valve including a valve member movable between closed and open positions relative to a valve seat for controlling water inflow to the sprinkler, the improvement comprising:

a flow restrictor disposed upstream from said valve seat for producing a pressure drop upstream from said valve seat when said valve member is in the open position; and a seat ring mounted on said sprinkler case at a position generally between said inlet fitting and said case interior, said seat ring having said valve seat formed thereon and further including a generally cylindrical boundary wall extending in an upstream direction from said valve seat to define a flow path at the upstream side of said valve seat, said flow restrictor being carried by said valve member to protrude into said flow path and including a radially outwardly extending metering bead formed thereon and positioned in relatively close clearance with said boundary wall to produce the pressure drop upstream from said valve seat when said valve member is in said open position.

15. The improvement of claim 14 further including a rock screen positioned generally at an upstream end of said flow path defined by said boundary wall.

16. The improvement of claim 14 wherein said inlet control valve includes pressure responsive means for displacing said valve member between said open and closed positions.

17. The improvement of claim 16 wherein said pressure responsive means comprises a spring biased diaphragm, and housing means cooperating with said diaphragm to define a control chamber at one side of said diaphragm.

18. The improvement of claim 14 further including a resilient seal member carried by one of said valve member and said valve seat.

* * * * *